United States Patent [19]

Ribatto

[11] 4,143,537

[45] Mar. 13, 1979

[54] METHOD FOR THE MANUFACTURE OF LOUD SPEAKERS

[76] Inventor: Jean-Jacques M. Ribatto, Rue du Marechal Foch, Vaux le Penil (Seine & Marne), France

[21] Appl. No.: 871,688

[22] Filed: Jan. 23, 1978

Related U.S. Application Data

[63] Continuation-in-part of Ser. No. 699,868, Jun. 25, 1976, abandoned.

[30] Foreign Application Priority Data

Jun. 27, 1975 [FR] France ..... 75 20339

[51] Int. Cl.[2] ..... B21D 22/00

[52] U.S. Cl. ..... 72/356; 29/594; 179/115.5 R

[58] Field of Search ..... 113/120 HA, 120 C; 179/115.5 R, 117, 119 R; 335/231; 29/594; 72/329, 341, 348, 352, 356, 377

[56] References Cited

U.S. PATENT DOCUMENTS

| | | | |
|---|---|---|---|
| 2,951,190 | 8/1960 | Boermann | 179/117 X |
| 3,191,421 | 6/1965 | Coen | 179/115.5 R X |
| 3,319,201 | 5/1967 | Coen | 179/119 R X |
| 3,453,400 | 7/1969 | Coen | 179/119 R |

FOREIGN PATENT DOCUMENTS

| | | | |
|---|---|---|---|
| 1104559 | 4/1961 | Fed. Rep. of Germany | 179/159.5 SF |
| 244051 | 7/1926 | United Kingdom | 179/159.5 R |

*Primary Examiner*—Leon Gilden
*Attorney, Agent, or Firm*—John T. Roberts

[57] ABSTRACT

A method for the manufacture of loud speakers of the type comprising in particular a pot for containing a magnet, which method is characterized in that the pot is made in one single piece by pressing and, to this end, a concave blank is formed; it is then pressed to give the blank the shape of a cone, which latter is closed, and the part to be crimped onto the protective cover is then made, the interior diameter measured, the base flattened and the height measured.

1 Claim, 5 Drawing Figures

METHOD FOR THE MANUFACTURE OF LOUD SPEAKERS

CROSS-REFERENCE TO RELATED APPLICATION

This invention is continuation in part in my co-pending application entitled "A Method for the Manufacture of Loud Speakers", Ser. No. 699,868, filed on June 25, 1976, now abandoned the priority of which is claimed for the common subject matter.

The present invention relates to a method for manufacturing loud speakers such as those used in sound reproduction units, in particular in low frequency circuitry, and the loud speakers made by the application of this method.

Loud speakers with a machined pot, comprising possibly pressed parts or a crimped or glued field plate are already known.

The pot in that case is made for example from a drawn steel bar. The base, on which the magnet is to be glued, is difficult to true up; thus, to obtain good surface flatness, it is necessary to free the center in the interior with the aid of a centering drill which reduces the central wall by about 1.55 mm. This results in a lack of uniformity in the thickness of the walls, particularly in the angles, magnetic leaks between the walls and the magnet, and also high cost.

When the pot is partially pressed and provided with an attached field plate, the efficiency is weakened relatively, as the contact between the pieces cannot be perfect; in addition, the field plate, which is attached to the motor, is crimped onto the protective cover, and constitutes a fragility factor which can lead to the separation of the motor from the protective cover as a result of somewhat rough handling. Finally, the cost price is still high.

The production of conventional pressed pots implies that it is impossible to make the necessary profiles and obtain precise dimensions, the tolerances for the interior diameter being 0.02 mm., and for the height being equally essential. In addition, conventional pressing flattens the radii obtained, which locally reduces the thickness of the metal sheet, and thus the efficiency, as the result of "strangling" of the magnetic flux in the relevant regions.

A method of making a loud speaker pot is disclosed in U.S. Pat. No. 3,191,421, issued to Aldo L. Coen. FIG. 1 of Coen shows the completed pot or field structure which is cylindrical in shape.

Coen describes his method as having six steps. They are: first step is to blank and draw the member into a half-sphere. The second step is to redraw the member into a cylindrical shape. The next step is to curl or neck the top of the cylinder. The fourth step is flat curling or further necking. The fifth step is cutting or grinding a portion of the neck to the desired size. The last step coins the shoulder and flattens the interior.

Each of the first four steps bends or forms the outside of the member. The surface which began as the blank and becomes the interior surface 22 is not touched until the cutting or grinding. As shown in the Coen drawings, there is considerable metal flow causing what Coen describes as a distorted portion. In addition, the third and fourth steps cause the buckling of the inner surface of the base which is counteracted in the last step by a punch to flatten the surface.

The object of the invention is to overcome these disadvantages and in particular to provide loud speakers of any dimension, low cost, and good efficiency and reliability.

To this end, the invention relates to method for the manufacture of loud speakers of the type comprising in particular a pot for containing a magnet, which method is characterized in that the pot is made in one single piece by pressing and, to this end, a concave blank is formed; it is then pressed to give the blank the shape of a cone, which latter is then closed, and the part to be crimped onto the protective cover is then made, the interior diameter measured, the base flattened, and the height measured.

As a result of making the pot in a single piece, which has not been machined, it is possible to obtain a loud speaker of relatively high efficiency.

According to an advantageous feature of the invention, by the pressing operation giving the shape of a cone, the top of the interior diameter of the latter is flattened.

It is this "flattening" at the top of the interior diameter which will later constitute the final dimension of the interior diameter during the last operation.

The invention also relates to a loud speaker made by the application of the method, characterized in that it comprises radially rounded walls in the central area of the longitudinal dimension.

The present invention will be described in greater details in the attached drawings in which.

Figure 1:
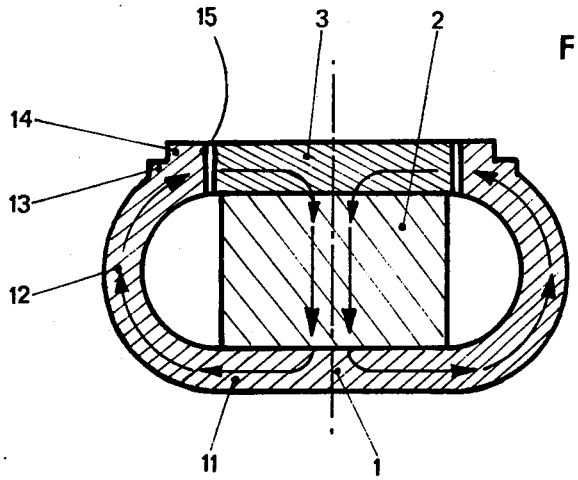
FIG. 1 shows in section some of the motor elements of the loud speaker made according to the invention.

The loud speaker according to the invention comprises a pot 1 that has been made here by pressing a single metallic piece, this pot 1 comprising a base 11 and radially rounded walls 12 in the central area of the pot considered longitudinally.

This rounding has a rounded convex shape, so that the distance between the walls 12 of the pot and the magnet 2 prevents magnetic leaks (the arrows represent the magnetic fluxes).

In addition, there is not the disadvantage of having crimped or glued field plates which consequently may uncrimp or become unglued.

The pot comprises, on the exterior, shoulders 12, 14 as well as an upper opening 15 for the passage of the magnet 2.

The magnet 2 which has a generally cylindrical form is covered by a core 3 enclosing the magnetic circuit in the region of the opening 15, and having a diameter slightly larger than that of said magnet 2.

The protective cover can obviously be secured in any suitable way.

To obtain good results it is necessary, before manufacture, to determine the necessary volume of material and then, on the blank and the first pressing, to make the flats and radii which it is desired to obtain on the finished piece.

Figure 2:
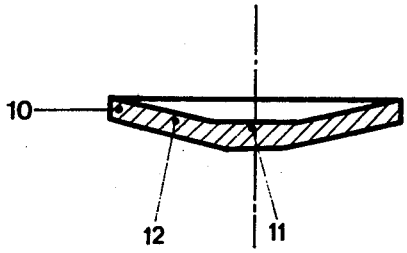
FIGS. 2 to 5 show in section the shape of the pot of the loud speaker on completion of some of the pahses of the method according to the invention.

The method of manufacture therefore consists in first cutting out and shaping a concave blank, which enables a precise angle to be obtained on the diameter of the blank (FIG. 2) formed by the base 11 and the walls 12.

Figure 3:
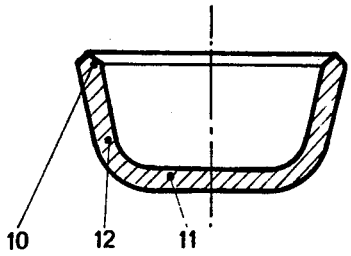

A conical pressing is then made, the flattening 10 at the top of the wall 12 coming from the upper part of the concave blank being intended later to constitute the final dimension of the interior diameter during the last operation (FIG. 3).

Figure 4:
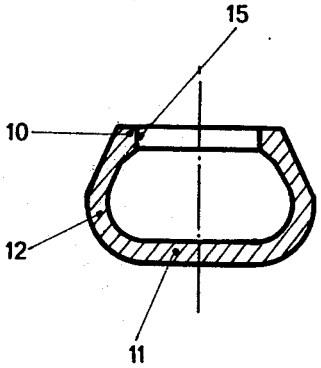

The cone is then closed by rounding the walls 12 (FIG. 4).

Figure 5:
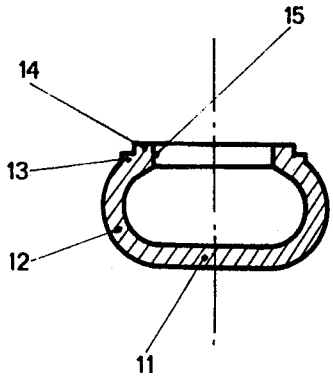

FInally, the part to be crimpled onto the protective cover is made, the interior diameter measured, the flatness of the base obtained, and the height measured (FIG. 5).

In greater detail, the first step is to cut or stamp a cylindrical section having a diameter which is required to supply the amount of metal for the finished pot.

The first step cuts out the blank and bends the blank to form the central base portion 11 and the wall section 12 which will later become spherical.

The second step does two things simultaneously. The walls 12 are bent up to the point where they are only slightly diverging, forming a minor concavity. At the same time, by a pressing or crushing action, a new surface is formed which will become the interior diameter of the pot. The original exterior periphery of the blank is formed into two surfaces forming an angle at the top of the member as shown in FIG. 3. The angle between the newly-formed surface 10 and the wall is, in the preferred embodiment, 43½° . The angle between new surface 10 and the other surface, to become the top, is approximately a right angle.

The third step also involves two simultaneous actions. The wall 12 is bent inwardly to a slight divergence to complete the lower portion of the spherical shape while the new surfaces are completely formed to a right angle, surface 10 perpendicular to the base and at the final diameter of the annular opening and the other surface parallel to the base.

The fourth step also involves two simultaneous actions. The top portion of the pot is pressed downward to form the completed spherical shape while the outside is notched to form the shoulder 13, 14 for the protective cover.

Although the present invention has been described with reference to a particular embodiment thereof, it should be understood that those skilled in the art may make many other modifications and embodiments thereof which will fall within the spirit and scope of the principles of this invention.

What is claimed as new and desired to be secured by patent of the United States is:

1. A method of manufacturing the pot of a loud speaker comprising the steps of:

a. forming a circular metallic blank;

b. pressing the blank to raise the walls forming a minor concavity around the central base;

c. pressing the concave blank into a cone with slightly diverging sides while forming an angle on the diameter of the sides of which angle are to form the interior diameter and the top of the pot, respectively;

d. pressing the top portion of the walls inwardly to form the annular opening with a vertical wall, said vertical wall being one of the sides of said angle, the other side of said angle forming the top of said pot;

e. pressing the recessed ring in the neck which cooperates with the protective cover of the loud speaker;

f. gauging the interior diameter and height and flattening the base.

* * * * *